US008021736B2

(12) United States Patent
Chang et al.

(10) Patent No.: US 8,021,736 B2
(45) Date of Patent: Sep. 20, 2011

(54) SUBSTANTIALLY FLAME RETARDANT-FREE 3GT CARPET

(75) Inventors: Jing C. Chang, Boothwyn, PA (US); Steven D. Beare, Wilmington, DE (US); Gregory A. Urove, Chesterfield, VA (US); John J. Kozlowski, Landenberg, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 584 days.

(21) Appl. No.: 11/774,000

(22) Filed: Jul. 6, 2007

(65) Prior Publication Data

US 2008/0014403 A1 Jan. 17, 2008

Related U.S. Application Data

(60) Provisional application No. 60/830,941, filed on Jul. 13, 2006.

(51) Int. Cl.
*B32B 33/00* (2006.01)
*D05C 17/02* (2006.01)
*D05C 15/00* (2006.01)

(52) U.S. Cl. ..... 428/97; 428/95; 156/72; 8/929; 8/930; 427/393.3; 427/389.9

(58) Field of Classification Search ..... 428/97; 8/929, 930; 156/72; 427/393.3, 389.9
See application file for complete search history.

(56) References Cited

U.S. PATENT DOCUMENTS

| | | | | |
|---|---|---|---|---|
| 5,645,782 | A | 7/1997 | Howell et al. | |
| 5,662,980 | A | 9/1997 | Howell et al. | |
| 6,113,825 | A * | 9/2000 | Chuah | 264/103 |
| 6,242,091 | B1 | 6/2001 | Howell et al. | |
| 6,284,370 | B1 * | 9/2001 | Fujimoto et al. | 428/364 |
| 6,315,934 | B1 * | 11/2001 | Chuah | 264/103 |
| 6,458,455 | B1 | 10/2002 | Hernandez et al. | |
| 6,641,916 | B1 | 11/2003 | Chang et al. | |
| 6,645,621 | B1 * | 11/2003 | Cordes et al. | 428/364 |
| 6,680,353 | B1 * | 1/2004 | Kato et al. | 524/497 |
| 6,684,618 | B2 | 2/2004 | Howell et al. | |
| 6,692,671 | B2 * | 2/2004 | Fujimoto et al. | 264/130 |
| 6,702,864 | B2 * | 3/2004 | Hwo et al. | 8/495 |
| 6,740,276 | B2 * | 5/2004 | Agarwal et al. | 264/177.13 |
| 6,752,945 | B2 | 6/2004 | Hernandez et al. | |
| 2002/0119311 | A1 * | 8/2002 | Fujimoto et al. | 428/364 |
| 2002/0197444 | A1 | 12/2002 | Lee et al. | |
| 2003/0028980 | A1 | 2/2003 | Song et al. | |
| 2003/0045611 | A1 * | 3/2003 | Agarwal et al. | 523/307 |
| 2003/0114062 | A1 * | 6/2003 | Scott et al. | 442/181 |
| 2004/0146711 | A1 | 7/2004 | Chang et al. | |
| 2004/0198120 | A1 * | 10/2004 | Scott et al. | 442/221 |
| 2005/0147784 | A1 | 7/2005 | Chang et al. | |
| 2009/0043016 | A1 * | 2/2009 | Chang et al. | 524/83 |
| 2009/0043021 | A1 * | 2/2009 | Chang et al. | 524/100 |
| 2009/0047857 | A1 * | 2/2009 | Chang et al. | 442/360 |

FOREIGN PATENT DOCUMENTS

| | | | |
|---|---|---|---|
| EP | 1 052 325 | A1 | 11/2000 |
| JP | 09003724 | A * | 1/1997 |
| WO | WO 2004/061170 | A1 | 7/2004 |

OTHER PUBLICATIONS

PCT International Search Report and Written Opinion for International Application No. PCT/US2007/015753 dated Feb. 21, 2008.

* cited by examiner

*Primary Examiner* — Cheryl Juska

(57) ABSTRACT

Substantially flame retardant-free carpets comprising poly (trimethylene terephthalate) yarn having minimal carrier and, optionally, minimal antistatic agent, are disclosed, as are methods for making such carpets.

16 Claims, No Drawings

SUBSTANTIALLY FLAME RETARDANT-FREE 3GT CARPET

CROSS-REFERENCE TO RELATED APPLICATIONS

This application claims priority under 35 U.S.C. §119 from Provisional Application No. 60/830,941 (filed Jul. 13, 2006), the disclosure of which is incorporated by reference herein for all purposes as if fully set forth.

FIELD OF THE INVENTION

The invention relates to substantially flame retardant-free carpets made of poly(trimethylene terephthalate) fibers comprising minimal carrier and, preferably, minimal antistatic agent.

BACKGROUND OF THE INVENTION

Carpets comprising bulked continuous filament (BCF) and/or staple yarns are made in a variety of manners known to those skilled in the art. Typically, a number of yarns are cable twisted together (about 3.5 to 6.5 turns per inch (about 1.38 to 2.56 turns/cm) and heat-set in a device (such as an autoclave) and then tufted into a primary backing. Latex adhesive and a secondary backing are then applied. Cut pile style carpets having a pile height between about 0.25 to 1 inches (about 0.64 to 2.54 cm), or loop pile style carpets having a pile height between about 0.125 to 0.375 inches (about 0.318 to 0.953 cm), can be made with BCF yarns. Typical carpet weights are between about 25 to 90 ounces per square yard (about 847.8 to 3051.9 g/m$^2$).

Carpets made from poly(trimethylene terephthalate) ("3GT" or "PTT") yarns have built-in stain resistance comparable to poly(ethylene terephthalate) ("2GT") yarns and satisfactory texture retention and resistance to crushing. Further, carpets comprising 3GT yarns have superior softness and dye capability compared to carpets made from 2GT yarns, and superior softness compared to carpets made from nylon.

Polyester carpets are generally dyed with disperse dyes with the aid of a carrier, which is a compound that functions to open the structure of a polyester to enhance dyeability with disperse dyes. Carrier is particularly useful to enhance 3GT dyeability in dark shades during continuous dyeing.

Antistatic agents are in general well-known to those of ordinary skill in the art and, in the context of carpets, are generally a topically applied chemical typically of a hygroscopic nature to reduce static levels. Antistatic agents are useful to reduce 3GT static levels for more demanding applications, such as computer rooms and commercial carpets, under American Association of Textile Chemists and Colorists (AATCC) Test Method 134 (GSA).

Carrier (and dye) and/or antistatic agent are generally applied to the carpet post-tufting.

Ideal, laboratory scale carpets produced from 3GT yarns are known to have a Class I flammability rating without the need for flame retardants. These ideal, laboratory scale carpets also do not contain carrier and antistatic agents.

Carpets comprising 3GT yarns used in real world applications, however, typically contain both carrier and antistatic agent, and have not been found to meet this flammability requirement without the use of significant amounts of flame retardants. Flame retardants, while improving the flammability rating of a carpet, are economically disadvantageous, and it would be desirable to minimize the amount of flame retardant necessary while still retaining suitable flammability ratings.

SUMMARY OF THE INVENTION

It has now been found that substantially flame-retardant free carpets can be produced from 3GT fibers by minimizing the amount of carrier in, and antistatic agent applied to, the 3GT fibers.

In accordance with one aspect of the present invention, therefore, there is provided a carpet comprising a poly(trimethylene terephthalate) yarn, a backing system and an adhesive system, wherein the poly(trimethylene terephthalate) yarn comprises a carrier in a range of from about 25 to about 3000 ppm by weight of the yarn, and/or an antistatic agent in an amount up to about 2500 ppm, and wherein the carpet is substantially flame retardant free.

Preferably, when a carrier is used, the carrier is present in a range of from about 25 to about 2000 ppm, even more preferably in range of from about 25 to about 1000 ppm, and most preferably in a range of from about 25 to about 500 ppm, by weight of the yarn.

Preferably, when antistatic agent is used, it is present in an amount up to about 2000 ppm, more preferably up to about 1000 ppm, and even more preferably up to about 760 ppm, by weight of the yarn. When antistatic agent is used, there must be at least some antistatic agent (even though no lower limit may be explicitly stated) in an amount to be effective in at least partially reducing static in conjunction with the intended effect of this component, as will be recognized by one of ordinary skill in the relevant art.

These carpets preferably have a Class I flammability rating, as determined by an ASTM-E648-type test.

Another aspect is to provide a first process of producing a substantially flame retardant-free carpet, as set forth above, comprising the steps of:

(a) producing a carpet comprising a poly(trimethylene terephthalate) yarn, a backing system, and an adhesive system;

(b) applying a carrier to the poly(trimethylene terephthalate) yarn; and (c) dyeing the poly(trimethylene terephthalate) yarn having a carrier applied thereto.

Optionally, the first process comprises a further step of applying antistatic agent to the poly(trimethylene terephthalate) yarn.

Another aspect is to provide a second process of producing a substantially flame retardant-free carpet, as set forth above, comprising the steps of:

(a) producing a carpet comprising a poly(trimethylene terephthalate) yarn, a backing system, and an adhesive system;

(b) dyeing the poly(trimethylene terephthalate) yarn; and (c) applying an antistatic agent to the poly(trimethylene terephthalate) yarn.

Optionally, the second process comprises a further step of applying a carrier to the poly(trimethylene terephthalate) yarn prior to dyeing.

Further, the step (a) in the above methods preferably comprises the steps of:

(a1) tufting the poly(trimethylene terephthalate) yarn into a primary backing;

(a2) applying a latex adhesive to the primary backing; and (a3) applying a secondary backing onto the latex adhesive.

DETAILED DESCRIPTION OF THE PREFERRED EMBODIMENTS

All publications, patent applications, patents and other references mentioned herein, if not otherwise indicated, are incorporated by reference herein in their entirety for all purposes as if fully set forth.

Unless otherwise defined, all technical and scientific terms used herein have the same meaning as commonly understood by one of ordinary skill in the art to which this invention relates. In case of conflict, the present specification, including definitions, will control.

Except where expressly noted, trademarks are shown in upper case.

Unless stated otherwise, all percentages, parts, ratios, etc., are by weight.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

When the term "about" is used in describing a value or an end-point of a range, the disclosure should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

"A" or "an" is employed to describe elements and components of the invention. This is done merely for convenience and to give a general sense of the invention. This description should be read to include one or at least one and the singular also includes the plural unless it is obvious that it is meant otherwise.

The materials, methods, and examples herein are illustrative only and, except as specifically stated, are not intended to be limiting. Although methods and materials similar or equivalent to those described herein can be used in the practice or testing of the present invention, suitable methods and materials are described herein.

In the context of this disclosure, a number of other terms are utilized.

"Carpet" as used herein includes, but is not limited to, cut pile and loop pile carpets used in residential and commercial applications, automotive carpets, carpet tiles, and bath and area rugs made from staple and/or bulked continuous filament yarn.

"Flame retardant" as used herein means any additive on and/or in the fiber and/or the backing system and/or latex adhesive as is known in the art to reduce the tendency of a carpet to burn, continue to burn, or flow after a source of ignition has been removed. Non-limiting examples of flame retardants used in the production of carpets include inorganic compounds, including, but not limited to, aluminum trihydrate (ATH), antimony oxide, zinc borate, and zinc stannate; halogenated organic compounds, including, but not limited to, pentabromodiphenyl ether, octabromodiphenyl ether, and hexabromobenzene; and phosphate compounds including, but not limited to, tribromopropyl phosphate. Flammability rating refers to the National Fire Protection Association's (NFPA) rating system for the flammability of materials, NFPA 253, also known as Federal Test Method 372 and American Society for Testing Materials ASTM-E648.

Typically, flame retardants are present on and/or in the fiber and/or backing system and/or adhesive system of a 3GT carpet in a range of from about 2% to about 6% by weight of the fiber and/or backing system (about 20000 ppm to about 60000 ppm). For example, 3GT carpets containing ATH typically measure about 2 to about 4 wt % aluminum, by weight of the carpet. Carpets containing no detectable amount of ATH generally contain about 1755 ppm (0.1755 wt %) aluminum or less. Carpets containing no detectable amount of phosphorus-containing flame retardants typically contain about 1100 ppm (0.11 wt %) or less phosphorous, and generally in the range of from about 600 ppm (0.06 wt %) to about 1100 ppm (0.11 wt %) phosphorus. Carpets containing no detectable amount of zinc-containing flame retardants typically contain about 1100 ppm (0.11 wt %) zinc or less, and generally in the range of from about 120 ppm (0.012 wt %) to about 1100 ppm (0.11 wt %) zinc. The term "detectable amount of a substance," as used herein, may include an amount of substance detectable using standard techniques known in the related art for the purposes of detecting the substance.

"Substantially flame retardant-free" as used herein means less than a useful amount, i.e., an amount capable of reducing the tendency of a carpet to burn, continue to burn, or flow after a source of ignition has been removed, of flame retardant on and/or in the fiber and/or backing system and/or adhesive system. A useful amount of flame retardant on and/or in the fiber and/or backing system and/or adhesive system of a 3GT carpet is more than about 20000 ppm flame retardant (about 2 wt %), by weight of the carpet. A "substantially flame retardant-free carpet" preferably contains less than about 2000 ppm (0.2 wt %), more preferably less than about 1000 ppm (0.1 wt %), still more preferably less than about 500 ppm (0.05 wt %), even more preferably less than about 50 ppm (0.005 wt %), and most preferably 0 ppm flame retardant(s) ("flame retardant free"), by weight of the carpet.

In the absence of an indication to the contrary, a reference to "poly(trimethylene terephthalate)" ("3GT" or "PTT") is meant to encompass homopolymers and copolymers containing at least about 70 mole % trimethylene terephthalate repeat units and polymer compositions comprising at least about 70 mole % of the homopolymers and copolymers. The preferred poly(trimethylene terephthalate)s contain at least about 85 mole %, more preferably at least about 90 mole %, still more preferably at least about 95 mole %, even more preferably at least about 98 mole %, and even still more preferably about 100 mole % trimethylene terephthalate repeat units.

"Poly(trimethylene terephthalate) bulked continuous filament yarn" or "3GT bulked continuous filament yarn" or "PTT bulked continuous filament yarn" can be made, for example, by the processes disclosed in U.S. Pat. No. 5,662,980, U.S. Pat. No. 5,645,782, U.S. Pat. No. 6,242,091, U.S. Pat. No. 6,684,618 and U.S. 2005/0147784A1, the disclosures of which are incorporated herein by reference in their entirety for all purposes as if fully set forth. However, any method of making such yarn as is known to one of ordinary skill in the art is acceptable.

"Poly(trimethylene terephthalate staple yarn" or "3GT staple yarn" or "PTT staple yarn" can be made, for example, by the processes disclosed in U.S. Pat. No. 6,752,945, U.S. Pat. No. 6,458,455, U.S. Pat. No. 6,641,916 and U.S. 2004/0146711A1, the disclosures of which are incorporated by reference herein in their entirety for all purposes as if fully set forth. However, any method of making such yarn as is known to one of ordinary skill in the art is acceptable.

"Carrier" as used herein means an aromatic organic compound whose function is to open the structure of 3GT, an aromatic polyester, to enhance dyeability with disperse dyes. Examples of carriers include, but are not limited to, benzyl benzoate; biphenyl butyl benzoate; butyl benzoate; butyl phthalimide; N,N-diethyl-m-toluamide (DEET); dimethyl phthalate; diphenyl ether; 2-ethyl hexylbenzoate; hexyl benzoate; isopropyl benzoate; octyl benzoate; o-phenyl phenol; propyl phthalimide; and trichloro-benzene. In embodiments where a carrier is present, the carrier is present in the carpet in a range of from about 25 to about 3000 ppm by weight of the poly(trimethylene terephthalate) yarn, more preferably in a range of from about 25 to about 2000 ppm, even more preferably in range of from about 25 to about 1000 ppm, and most preferably in a range of from about 25 to about 500 ppm.

"Antistatic agent" as used herein is a topically applied chemical of a hygroscopic nature. Examples of antistatic agents include, but are not limited to, dibutyl phosphates, diethanolamides, ethoxylated tertiary fatty acid amines, long chain polyethylene oxide compounds, and quaternary ammonium compounds. The amount of antistatic agent in a carpet sample is determined by means well know to those of ordinary skill in the relevant art.

For example, residual dibutyl phosphate is detected by High Pressure Liquid Chromatography (HPLC). For purposes of this invention, residual dibutyl phosphate values in ppm reflect dibutyl phosphate comprising about 75% of the antistatic agent. Thus, for example, 500 ppm residual dibutyl phosphate reflects antistatic agent being present in the carpet at about 666.7 ppm by weight of the poly(trimethylene terephthalate) yarn. In embodiments where antistatic agent is present in the carpet, the antistatic agent is present up to about 1875 ppm residual dibutyl phosphate (2500 ppm antistatic agent) by weight of the poly(trimethylene terephthalate) yarn, preferably up to about 1500 ppm residual dibutyl phosphate (2000 ppm antistatic agent), more preferably up to about 750 ppm dibutyl phosphate (1000 ppm antistatic agent), and even more preferably up to about 570 ppm residual dibutyl phosphate (760 ppm antistatic agent).

In embodiments free of a carrier, a method of producing flame retardant-free carpets comprises:

(a) tufting poly(trimethylene terephthalate) yarn to produce a carpet;

(b) dyeing said carpet; and (c) applying antistatic agent to said carpet.

Carrier and/or antistatic agent typically (but not always) are applied to the carpet post-tufting. Application of a carrier and, optionally, an antistatic agent to the tufted carpet can be performed by any method as is known to one of ordinary skill in the art. Preferably, a carrier is applied by addition to the dye bath or liquor in beck (batch) and continuous (range) dyeing, as well as by way of a residual carrier in the rinse tanks of a continuous dye range. Antistatic agent is preferably applied by spray application on dyed carpet after extraction and before drying.

Carpets of the invention comprising a carrier can be dyed by any method known to one of ordinary skill in the art. Particularly preferred methods are those used to dye carpets comprising poly(ethylene terephthalate) yarns. In one embodiment, carrier application and carpet dyeing can be performed substantially simultaneously, preferably simultaneously.

EXAMPLES

The present invention is further defined in the following Examples. It should be understood that these Examples, while indicating preferred embodiments of the invention, are given by way of illustration only. From the above discussion and these Examples, one skilled in the art can ascertain the preferred features of this invention, and without departing from the spirit and scope thereof, can make various changes and modifications of the invention to adapt it to various uses and conditions.

The meaning of abbreviations is as follows: "h" means hour(s), "min" means minute(s), "sec" means second(s), "m" means meter(s), "cm" means centimeter(s), "g" means gram(s), "oz" means ounce(s), "$yd^2$" means square yard(s), "dpf" means dernier per filament, "mg" means milligram(s), "kg" means kilogram(s), "mL" means milliliter(s), "μL" means microliter(s), "in" means inch(es), "3GT" means poly (trimethylene terephthalate), "2GT" means poly(ethylene terephthalate), "mpm" means meters per minute, "rpm" means revolutions per minute, "ppm" means parts per million, and "wt %" means weight percent(age).

EXPERIMENTAL

A 1400-1500 denier, 18-20 dpf, bulked continuous filament (BCF) yarn was spun from 3GT polymer at a spinning temperature of about 250° C. and at a spinning speed of about 2500-3500 mpm. Fiber cross section was trilobal with a 1.7-3.0 Modification Ratio.

The BCF yarns were cable-twisted at a twist level of about 3.5-6 turns per inch (8.9-15.2 turns/cm) and a speed of about 4500-7000 rpm on a cable twister. The twisted BCF yarns were continuously heat set using a Superba tunnel equipped with a circulating steam system. Either a straight set coiler or a conventional stuffer box was used, with a prebulker temperature of about 190-208° F. (87.8-97.8° C.) and a tunnel temperature of about 270-300° F. (132.2-148.9° C.). Belt speed was about 10-20 mpm, and tunnel length was 6-12 m.

Medium density residential cut pile carpets with a basis weight of 25-75 $oz/yd^2$ (847.8-2543.3 $g/m^2$) were tufted from the 3GT heat set yarns. Full width (12-15 feet wide (3.62-4.57 m)) was continuously range-dyed at a pH of 4.0-8.0 in a beige color using a horizontal steamer, or was otherwise dyed by a beck dyeing process (such as would be known to one of ordinary skill in the art). 0.5%-5.0% carrier on weight of carpet, normally used to dye 2GT polyester, was added to the dye mix. The chemicals that were used in the dyeing and finishing dye process are listed in Table 1. Typical chemicals were used in latexing (83.5% solids)—filler ($CaCO_3$) and styrene butadiene rubber (SBR) latex. Latex was at 425 parts.

TABLE 1

| Chemical | Wt % |
|---|---|
| Water Conditioner | 0.1-1% |
| Nonionic Wetting Agent | 0.1-1% |
| Buffer | As Needed |

TABLE 1-continued

| Chemical | Wt % |
|---|---|
| Carrier | 0.5-5% |
| Disperse Dyes (Beige) | 0.1-2% |

The continuous dyeing process was:

1. Back Beat & Vacuum
2. Pre-Steam at 175-200° F. (79.4-93.3° C.)
3. Dye application at 400% wet pickup, apply at 90° F. (32.2° C.)
4. Steam 8-10 min. at 208° F. (97.8° C.)
5. Three post-washes & -extractions
6. Optional topicals dryer; e.g., antistatic agent, fluorochemical
7. Dry in a multiple zone dryer starting at 280° F. (137.8° C.) and ending at 260° F. (126.7° C.)
8. Process speed was 50-150 feet per minute (15.2-45.7 mpm)

The latexing process was:

1. Apply latex at 4-10 oz/yd$^2$ (135.6-339.1 g/m$^2$) on the secondary backing
2. Apply latex at 15-35 oz/yd$^2$ (508.7-1186.9 g/m$^2$) on the primary backing
3. Run under marriage roll
4. Process speed—50-150 feet per minute (15.2-45.7 mpm)
5. Cure starting at about 425° F. (218.3° C.) and ending at about 320° F. (160° C.)

Carrier Analysis Procedure

Face fibers were sheared off of the carpet such that no backing material remained on the fibers. 1.0 g of fiber was placed into a 40 mL screw top vial, which was then filled with 20.0 mL of methanol. The vial was then placed into a water bath at 60° C. for 2 h., after which the vial was removed and allowed to come to room temperature. A disposable pipette was used to transfer 2 mL of solution into a gas chromatography (GC) vial. The solution was then analyzed by GC using an external standard calibration procedure. This procedure determined the concentration of a carrier.

Instrumentation Parameters:

GC Conditions:
GC Model: Agilent 6890
GC Column: HP 5, 30 m×0.25 mm×250 mm
Oven Conditions: Initial Temp.=40° C.
Initial Time=0 min.
Rate=10° C./min.
Final Temp.=200° C.
Final Time=16 min.
Split Ratio: 20.92:1
Split Flow: 20.9 mL/min.
Total Flow: 24.5 mL/min.
Flow Rate: 1.0 mL/min.
Flow Mode: Constant Flow
Carrier Gas: Helium
Detector (FID) Temp.: 300° C.
Hydrogen Flow: 30 mL/min.
Air Flow: 400 mL/min.
Combined Flow: 25.0 mL/min.
Data Rate: 10 Hz
Injection Size: 1 μL
Calculation Mode: External Standard Percent
Software: HP Chemstation Version A. 08.03

Extraction Vial: VWR Traceclean Precleaned, 40 mL vial, clear borosilicate

Extraction Solution: Methanol, EMD Science, for GC, High Pressure Liquid Chromatography (HPLC), Spectrometry, and gradient analysis Example 1

The methamine pill test is described in FF 1-70 as found in 16 CFR §1630 and also ASTM D-2859, Surface Flammability of Carpets and Rugs.

Burn performance describes the average burn distance of the pill test totals indicated in the Tables below. After the flame on a sample was extinguished, one burn measurement was taken, which was the minimum distance from the burn edge to an eight inch circular metal template (the burn distance). Typically a carpet sample was divided into eight subsamples, each the size of the circular metal template, and an average burn distance was calculated based on the averaged burn measurements (the burn distance). Burn distance was thus an inverse measure of the amount a carpet sample burns; e.g., a carpet that did not burn had a burn distance of 4.0 in., while a carpet that burned completely from the center of the circular metal template to the edge of the circular metal template had a burn distance of 0.0 in.

As used herein, an average burn distance of greater than 3.0 in. indicates excellent burn performance. An average burn distance of greater than 1.0 in. to 3.0 in. (burn performance of greater than 1.0 in. is a "pass" under the pill test) indicates marginal burn performance. An average burn distance of less than or equal to 1.0 in. (fails pill test) indicates poor burn performance. Average burn distance for carpet samples 1-4 is presented in Table 2.

TABLE 2

| Carpet Sample | Stage | Carrier (ppm) | Pill Test (Pass/Total) | Burn Performance | Burn Distance (in.)[1] |
|---|---|---|---|---|---|
| 1 | Tufted | 0 | 5/5 | Marginal | 2.85 |
| | Dyed | 3968 | | | |
| | Finished | 3557 | | | |
| 2 | Tufted | 0 | 7/8 | Marginal | 2.35 |
| | Dyed | 4328 | | | |
| | Finished | 4062 | | | |
| 3 | Tufted | 0 | 8/8 | Marginal | 2.72 |
| | Dyed | 4077 | | | |
| | Finished | 3651 | | | |
| 4 | Tufted | 0 | 7/8 | Marginal | 2.35 |
| | Dyed | 4843 | | | |
| | Finished | 3617 | | | |

[1]Average distance from edge of burn to circular template-preferred distance >3.0 in.

The examples in Table 2 were typical pill test results for residual carrier levels in the 3500-4000 ppm range for four different residential cut pile carpets. As tufted carpets had no detectable carrier, while carpets dyed with a small amount of carrier contain 4000-5000 ppm carrier. After finishing (backing/latexing), carrier dropped noticeably to the 3500-4000 ppm range. In all cases, burn distances for carpets dyed with 4000-5000 ppm carrier were relatively low, i.e. <3.0 in., indicating a marginal burn performance despite technically passing the pill test. Commercial production of carpets with these marginal pill test results would require a flame retardant to ensure consistent results.

TABLE 3

| Carpet Sample | Carpet Weight (oz/yd$^2$) | Latex Weight (oz/yd$^2$) | Carrier (ppm) | Pill Test (Pass/Total) | Burn Performance |
|---|---|---|---|---|---|
| 5 | 26 (881.7 g/m$^2$) | 28.2 (956.3 g/m$^2$) | 368 | 8/8 | Excellent |
| 6 | 40 (1356.4 g/m$^2$) | 30.7 (1041.0 g/m$^2$) | 273 | 8/8 | Excellent |

The carpet samples in Table 3 were typical pill test results for different residential cut pile carpets containing residual carrier levels in the 25-400 ppm range. Burn distances were typically greater than 3.5 in., an excellent result. Carpet samples containing between 25 to 3000 ppm of carrier passed the pill test and had burn distances typically greater than 3.5 in., an excellent result, requiring no use of flame retardants. Control carpet samples containing no carrier passed the pill test and have burn distances greater than 3.5 in.

Example 2

To analyze residual dibutyl phosphate, samples were tested using a HPLC with negative ion electrospray mass spectrometric detection system (SIM mode). Mobile phase was water (containing 200 mg/L ammonium carbonate) with an isopropanol gradient. Samples were extracted with deionized water in an ultrasonic bath and filtered prior to injection (samples warm to touch when removed from bath after ~1 h.). Column used was a Hypercarb (Thermo Electron Corp., San Jose, Calif.) 3×150 mm, 5 μm, at 80° C.

TABLE 4

| Carpet Sample | Carpet After-treatment | Carrier (ppm) | Dibutyl phosphate (ppm) | Pill Test (Pass/Total) | Burn Performance |
|---|---|---|---|---|---|
| 7 | Control | 542 | 4200 | 5/8 | Poor |
| 7A | Dried @ 150° C. for 1 hr. | 214 | 3200 | 2/8 | Poor |
| 7B | Hot Water Extraction | 413 | 570 | 8/8 | Excellent |

A 3GT control carpet sample 7 was topically treated with 3M Protective Chemical PM-1451 (available from 3M Protective Materials Division, 3M Center, St. Paul, Minn.) and antistatic agent. From a carpet manufacturing perspective, it would be practical to dye a 3GT carpet in the same mill at about the same time as a 2GT carpet. A 3GT carpet dyed in such a mill could absorb residual carrier present after a 2GT dyeing process. Thus, the carpet sample contains a small amount of residual carrier, 542 ppm, absorbed from the rinse bath after a 2GT carpet dyeing. The presence of a relatively high amount, 4200 ppm, of antistatic agent, as measured by dibutyl phosphate, was responsible for the poor pill test performance and poor burn performance. When the carpet sample 7 was heated at about 150° C. for about 1 h., some of the carrier was removed along with some of the antistatic agent, but the pill test performance and burn performance were still poor (carpet sample 7A). Because the antistatic agent was water soluble, hot water extraction (a common steam cleaning procedure used to clean carpets) significantly reduced the level of antistatic agent, as measured by residual dibutyl phosphate, which resulted in acceptable pill test performance (carpet sample 7B) and excellent burn performance.

It was assumed that the dibutyl phosphate comprised about 75% of the antistatic agent present in the carapet samples. Thus, for carpet sample 7, antistatic agent was present in the carpet at about 5600 ppm; for carpet sample 7A, antistatic agent was present in the carpet at about 4267 ppm; and, for carpet sample 7B, antistatic agent was present in the carpet at about 760 ppm.

TABLE 5

| Carpet Sample | Carrier (ppm) | Dibutyl phosphate (ppm)[2] | Pill Test (Pass/Total) | Burn Performance |
|---|---|---|---|---|
| 8 | 74 | <150 | 8/8 | Excellent |
| 9 | 29 | <150 | 8/8 | Excellent |
| 10 | 52 | <150 | 8/8 | Excellent |
| 11 | 51 | <150 | 8/8 | Excellent |
| 12 | 33 | <150 | 8/8 | Excellent |
| 13 | 278 | <150 | 8/8 | Excellent |
| 14 | 185 | <150 | 8/8 | Excellent |

[2]Limit of detection was 150 ppm

The carpet samples in Table 5 were typical pill test results for different residential cut pile carpets containing residual carrier in the 25-300 ppm range and residual antistatic agent levels less than 150 ppm (limit of detection) as measured by residual dibutyl phosphate. Burn distances were typically greater than 3.5 in., an excellent result.

The invention claimed is:

1. A carpet comprising a poly(trimethylene terephthalate) yarn tufted into a backing with an adhesive applied thereto, wherein the poly(trimethylene terephthalate) yarn comprises a carrier in a range of from 25 to 3000 ppm by weight of the yarn, up to 760 ppm by weight of an antistatic agent; wherein the carpet is substantially flame retardant free, and wherein the carpet exhibits an average burn distance of >3 inches according to ASTM D-2859.

2. The carpet of claim 1, wherein the poly(trimethylene terephthalate) yarn comprises the carrier in a range of from 25 to 2000 ppm by weight of the poly(trimethylene terephthalate) yarn.

3. The carpet of claim 1, wherein the poly(trimethylene terephthalate) yarn comprises the carrier in a range of from 25 to 1000 ppm by weight of the poly(trimethylene terephthalate) yarn.

4. The carpet of claim 1, wherein the poly(trimethylene terephthalate) yarn comprises the carrier in a range of from 25 to 500 ppm by weight of the poly(trimethylene terephthalate) yarn.

5. The carpet of claim 1, wherein the carpet contains less than 2000 ppm (0.2 wt %) flame retardant(s), by weight of the carpet.

6. The carpet of claim 1, wherein the carpet contains no more than 1755 ppm (0.1755 wt %) aluminum, no more than 1100 ppm (0.11 wt %) phosphorous, and no more than 1100 ppm (0.11 wt %) zinc, by weight of the carpet.

7. A process of producing a substantially flame retardant-free carpet as set forth in claim 1, comprising the steps of:

(a) tufting a poly(trimethylene terephthalate) yarn to produce a carpet comprising a poly(trimethylene terephthalate) yarn, a backing system, and an adhesive system;

(b) applying a carrier to the poly(trimethylene terephthalate) yarn; and (c) dyeing the poly(trimethylene terephthalate) yarn.

8. The process of claim 7, further comprising the step of applying an antistatic agent to the poly(trimethylene terephthalate) yarn.

9. The process of claim 7, wherein the tufting step (a) comprises the steps of:

(a1)) tufting the poly(trimethylene terephthalate) yarn into a primary backing;

(a2) applying a latex adhesive to the primary backing; and (a3) applying a secondary backing onto the latex adhesive.

10. The process of claim 7, wherein the carpet contains less than about 2000 ppm (0.2 wt %) flame retardant(s), by weight of the carpet.

11. The process of claim 7, wherein the carpet contains no more than about 1755 ppm (0.1755 wt %) aluminum, no more than about 1100 ppm (0.11 wt %) phosphorous, and no more than about 1100 ppm (0.11 wt %) zinc, by weight of the carpet.

12. A process of producing a substantially flame retardant-free carpet as set forth in claim 1, comprising the steps of:

(a) tufting a poly(trimethylene terephthalate) yarn to produce a carpet comprising a poly(trimethylene terephthalate) yarn, a backing system, and an adhesive system;

(b) dyeing the poly(trimethylene terephthalate) yarn; and (c) applying an antistatic agent to the poly(trimethylene terephthalate) yarn.

13. The process of claim 12, further comprising the step of applying a carrier to the poly(trimethylene terephthalate) yarn prior to dyeing.

14. The process of claim 12, wherein the tufting step (a) comprises the steps of:

(a1)) tufting the poly(trimethylene terephthalate) yarn into a primary backing;

(a2) applying a latex adhesive to the primary backing; and (a3) applying a secondary backing onto the latex adhesive.

15. The process of claim 12, wherein the carpet contains less than about 2000 ppm (0.2 wt %) flame retardant(s), by weight of the carpet.

16. The process of claim 12, wherein the carpet contains no more than about 1755 ppm (0.1755 wt %) aluminum, no more than about 1100 ppm (0.11 wt %) phosphorous, and no more than about 1100 ppm (0.11 wt %) zinc, by weight of the carpet.

* * * * *